United States Patent [19]

Corbett

[11] Patent Number: 4,905,821

[45] **Date of Patent: * Mar. 6, 1990**

[54] JEWELRY DISPLAY DEVICE

[76] Inventor: Mary D. Corbett, 1529 N. Cardington Ct., Wichita, Kans. 67212

[ * ] Notice: The portion of the term of this patent subsequent to Aug. 18, 2004 has been disclaimed.

[21] Appl. No.: 82,572

[22] Filed: Aug. 5, 1987

Related U.S. Application Data

[63] Continuation-in-part of Ser. No. 758,166, Jul. 23, 1985, Pat. No. 4,687,103.

[51] Int. Cl.[4] ..... B65D 5/52

[52] U.S. Cl. ..... 206/45.24; 206/566; 206/6.1

[58] Field of Search ..... 206/45.24, 566, 6.1

[56] References Cited

U.S. PATENT DOCUMENTS

| | | | |
|---|---|---|---|
| 4,324,446 | 4/1982 | LeSage | 206/45.34 |
| 4,413,736 | 11/1983 | Nibling | 206/457 |
| 4,687,103 | 8/1987 | Corbett | 206/566 |

FOREIGN PATENT DOCUMENTS

| | | | |
|---|---|---|---|
| 2421601 | 1/1975 | Fed. Rep. of Germany | 206/45.34 |
| 2736539 | 2/1979 | Fed. Rep. of Germany | 206/312 |

*Primary Examiner*—Joseph Man-Fu Moy

[57] ABSTRACT

A device for displaying or storing jewelry such as pierced earrings, medals, nametags and like items having a decorative front portion and a back portion having at least one pin-like shaft, post or hook which may cooperate with a clamp to hold such items in place on the user's clothing or body. The device provides a virtually infinite number of positions and relationships in which such times can be displayed. It consists of a panel of woven material or mesh stretched and mounted to an inner frame which is fitted into a recess or groove (rabbet) in an outer frame and whereby the rough edges of mesh are hidden from view. The post or hook of an item such as a pierced earring is inserted through the mesh, and the clamp, if provided, is attached from the back of the frame to hold the item in place. Optionally, means may be provided to hold the device in an upright position and/or suspend it from a vertical surface such as a wall. The preferred means of support would provide easy access to the back of the display panel, such as by use of a curved supporting leg or by use of hinges.

1 Claim, 7 Drawing Sheets

JEWELRY DISPLAY DEVICE

This patent application is a Continuation-in-Part of co-pending patent application 758,166 which was filed on 7/23/85, now U.S. Pat. No. 4,687,103.

BACKGROUND OF THE INVENTION

1.Field of the Invention

This invention generally relates to devices for holding and displaying those articles of jewelry, decorations, nametags, medals and the like which have a front decorative or informative portion and at least one pin-like shaft or hook such as those found on pierced earrings, and a device for engaging the pin-like shaft and thereby holding the item in position.

2.Description of the Prior Art

U.S. Pat. No. 4,606,458 teaches a framed display surface comprising a flexible mesh screen for receiving and holding an article to be displayed and a pair of interdependent coaxially arranged hoops supporting said flexible mesh screen therebetween; the flexible mesh screen is retained between the hoops by an annular band of decorative material extending downwardly between the hoops, then horizontally outward. The device stretches the mesh screen in a manner similar to many embroidery hoops. The annular band of decorative material is used both to retain the flexible mesh in the hoop and to hide the rough edges of the mesh from the front view of the device. Like the stretched fabric in an embroidery hoop, the flexible mesh and annular band of fabric in such display devices tends to loosen with continued handling, and the rough edges of the mesh remain visible from the back of the hoops.

In addition, in the preferred embodiment of this device, apertured fabric support straps, extending from fittings on the outer edges of the hoop are provided for holding the device in an elevated manner, presumably hanging from a wall. Hence, even though it is possible to attach earring backs to their posts, this arrangement does not provide easy access to the back of the frame. The frame has to be lifted away from the wall and held in order to attach the earring backs. In order to avoid this inconvenience, in the preferred embodiment of the device the jewelry posts are retained by the friction between the posts and support material. The principle disadvantages of this arrangement are that the earring backs are more easily stored in a separate receptacle and hence are not matched with the proper earrings, and the earrings are not securely held in the mesh without their clasps.

SUMMARY OF THE INVENTION

Applicant has found a method for overcoming these limitations so that there is little or no loosening of the flexible mesh display panel with use and the rough edges of mesh or woven material are not visible from the back of the device. In addition, a stand and a method for hanging the device from a wall are taught that provide unobstructed access to the back of the display panel for attaching the jewelry clasps.

These results are achieved by a jewelry display device comprising an outer frame having a central opening and a rabbet extending inwardly from and surrounding a substantial portion of the periphery of said opening; an inner frame shaped and sized to be received in said rabbet; a mesh panel adapted to be penetrated by the pin-like shaft or hook and having means for attaching said panel to said inner frame; and means for holding the device in a substantially upright position. The inner and outer frames may have a rectangular or curved shape.

Suitable materials for the display panel include any fabric, cloth, woven material, mesh, screen or synthetic material with a woven appearance that is capable of being pierced by the pin-like shafts of jewelry items. Suitable materials for construction of the inner and outer frames would be any material or materials having enough rigidity to permit the apparatus to stand and hold the display panel in an upright position, including, but not limited to plastic, wood, ceramic and metal.

In one preferred embodiment of this invention, the display panel is made of a durable, open-weave fabric, such as vinyl-coated polyester. This is attached to the inner frame by various means, including, but not limited to glue, fasteners such as staples, or when the inner frame is made of plastic, the display panel may be attached by plastic molded through the weave of the fabric. In this embodiment, the stretching and mounting of the woven panel are independent of the arrangement of the frames, and therefore little or no loosening of the panel would occur as a result of handling of the frames. In the preferred embodiment, the inner frame is inserted into the rabbet through a slot in the bottom of the outer frame so that the front of the inner frame, with its rough fabric edges, is hidden from view. In this embodiment, only the inside edge of the inner frame is exposed to view; it is visible from the back of the outer frame, and is preferably finished in the same way as the outer frame. Optionally, the opening to the rabbet could be located in any of the four side edges of the outer frame: the left side edge, right side edge, top edge or bottom edge. A back opening to the rabbit is also possible, and is necessary for constructing some curved embodiments of this device, where it may not be possible or aesthetically desirable to construct the device so that the inner frame is inserted through a slot in one edge of the outer frame.

The inner frame would preferably be held in place in the outer frame by a snug compression fit, or alternately, by an obstruction inserted into the channel, preventing the inner frame from sliding out. Where the frames are made of plastic, the inner frame can be held in place by areas of melted plastic between the inner and outer frames.

Optionally, the device may be provided with means for holding the frame in a vertical or nearly vertical position. The preferred stand is a curved leg that is detachably inserted into an aperture on one side of the back of the outer frame. By being flared outward toward the bottom of the frame, this stand provides an attractive, sturdy support that does not interfere with access to the back of the frame. Optionally, the stand may be permanently attached, or two stands may be used, one on each side of the frame.

In another preferred embodiment, the frame may be attached to a wall with side hinges, in a manner similar to a door. This would provide easy access to the back of the frame by allowing the frame to swing away from the wall. In this embodiment, a device such as a magnet or hook would be attached to the frame to keep the jewelry display device parallel to the wall when not in use.

BRIEF DESCRIPTION OF THE DRAWINGS

Illustrative embodiments of the invention are shown in the accompanying drawings wherein.

DESCRIPTION OF THE PREFERRED EMBODIMENT

The device of this invention is particularly adapted for displaying and/or storing those decorative items, such as name tags, decorations, and jewelry items such as earrings for pierced ears, having pin-like shafts or posts attached to the rear side of a base and a decorative portion secured to the front of the base. Such pin-like shafts may attach to clips, clamps, bolts and like holding means for securing the item to the clothing or body of the user. The shafts may vary. For example, earring posts are generally thin, needle-like pins, but in the case of medals, decorations, nametags and the like, the pin-like shaft has to be strong enough to pierce a thick, tightly woven fabric.

This device is also adapted for displaying earrings having wire or hook style backs, where the hooks are inserted through the display panel with no need for a back clamp. Items of jewelry that do not have a pin-like shaft or post, such as bracelets or necklaces, may also be displayed by hanging them from a separate hook adapted to be received by the mesh display panel.

Figure 1:
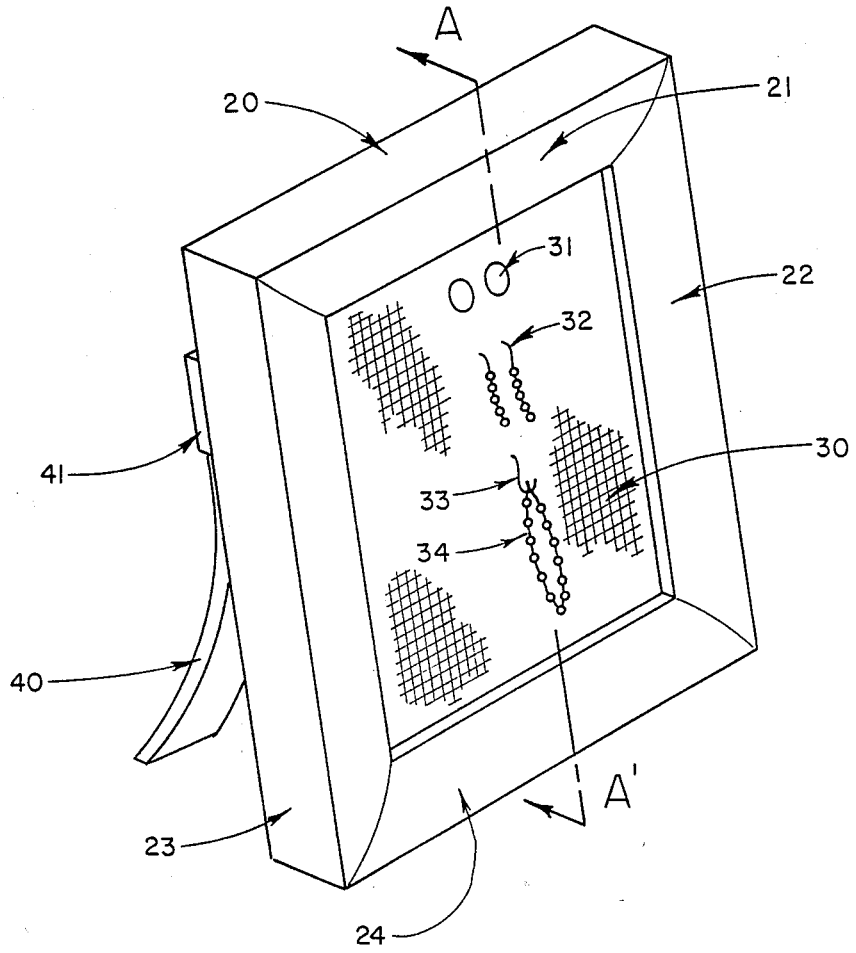
FIG. 1 is a perspective view of a rectangular embodiment of my device for holding jewelry and the like for display and/or storage.
Figure 2:
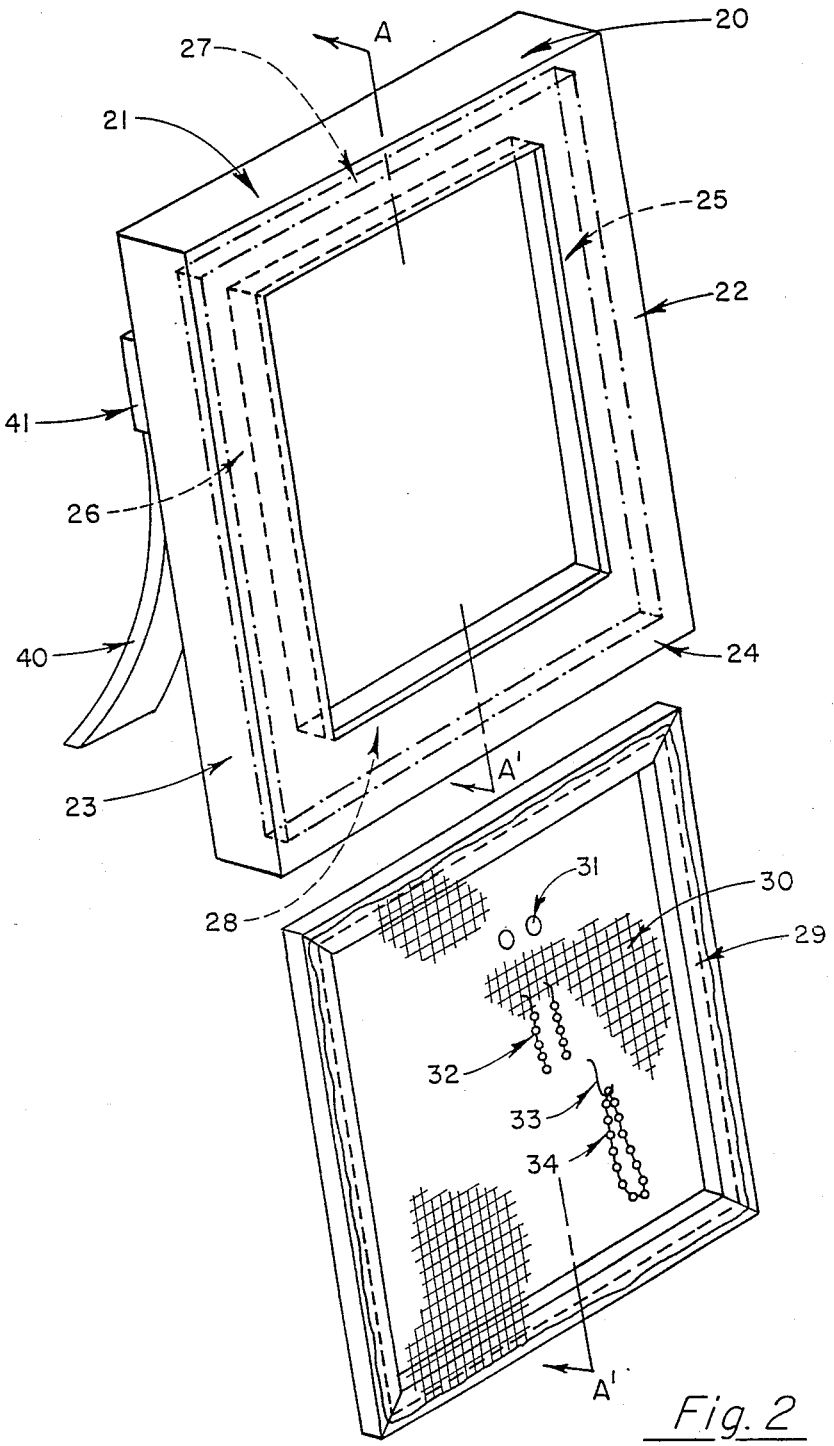
FIG. 2 is an exploded perspective view of the embodiment shown in FIG. 1.
Figure 3:
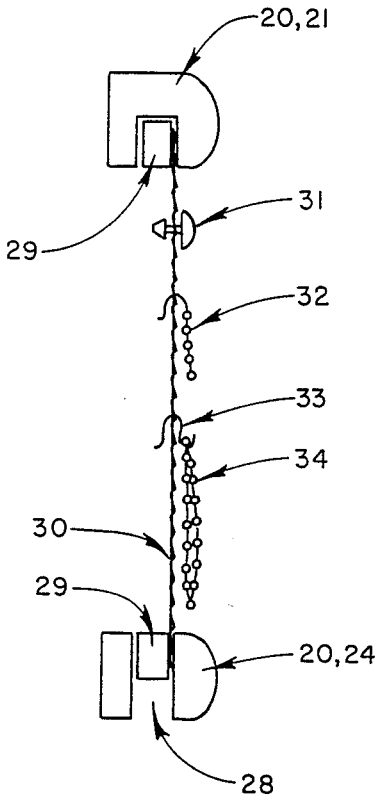
FIG. 3 is a cross-section view of the device as seen along plane A—A' of FIG. 1.

The inner frame is inserted into the rabbet in the outer frame. Various means for providing access to the rabbet result in several preferred embodiments. FIG. 1 is a perspective view of one preferred embodiment of the jewelry display device in a rectangular configuration. FIG. 2 is an exploded perspective view of the device of FIG. 1 and FIG. 3 is a cross-section taken in plane A—A' of FIG. 1. This preferred embodiment is comprised of an outer frame 20 having an upper frame portion or top edge 21, a right side outer frame portion or right side edge 22, a left side outer frame portion or left side edge 23, and a bottom frame portion or bottom edge 24. A rabbet 25 in the shape of a channel or groove is provided in the right side frame portion 22, a rabbet 26 on the left side frame portion 23, and a rabbet 27 in the upper frame portion 21. The rabbet 28 provided in the bottom frame portion 24 extends through the bottom frame portion to the outer perimeter of the outer frame, forming a slot to provide access to the rabbet for inserting the inner frame into the outer frame. Optionally, the slot opening could be in the left side edge 23, the right side edge 22, or the top edge 21.

The embodiment further comprises an inner frame 29 having a panel of woven material or mesh 30 fixed to it, such as by staples or by plastic molded through the mesh. The preferred material has a durable open weave, such as vinyl-coated polyester. The inner frame with its attached mesh panel is held in the corresponding rabbet portions of the outer frame preferably by a compression fit, by an obstruction such as a spring clip inserted into the slot 28, or by areas of melted plastic between the inner and outer frames.

FIG. 3 shows display articles such as a post earring 31 and a wire or hook earring 32. A hook 33 may also be adapted for use on the display surface so that it can hold other items of jewelry such as a bracelet or necklace 34. In this embodiment, the fabric 30 is attached to the front-facing portion of the inner frame 29, and the attachment surface with its rough edges of mesh, and three sides of the inner frame are substantially hidden by the rabbet in the outer frame 20. The inner frame is inserted through the slot 28.

Figure 4:
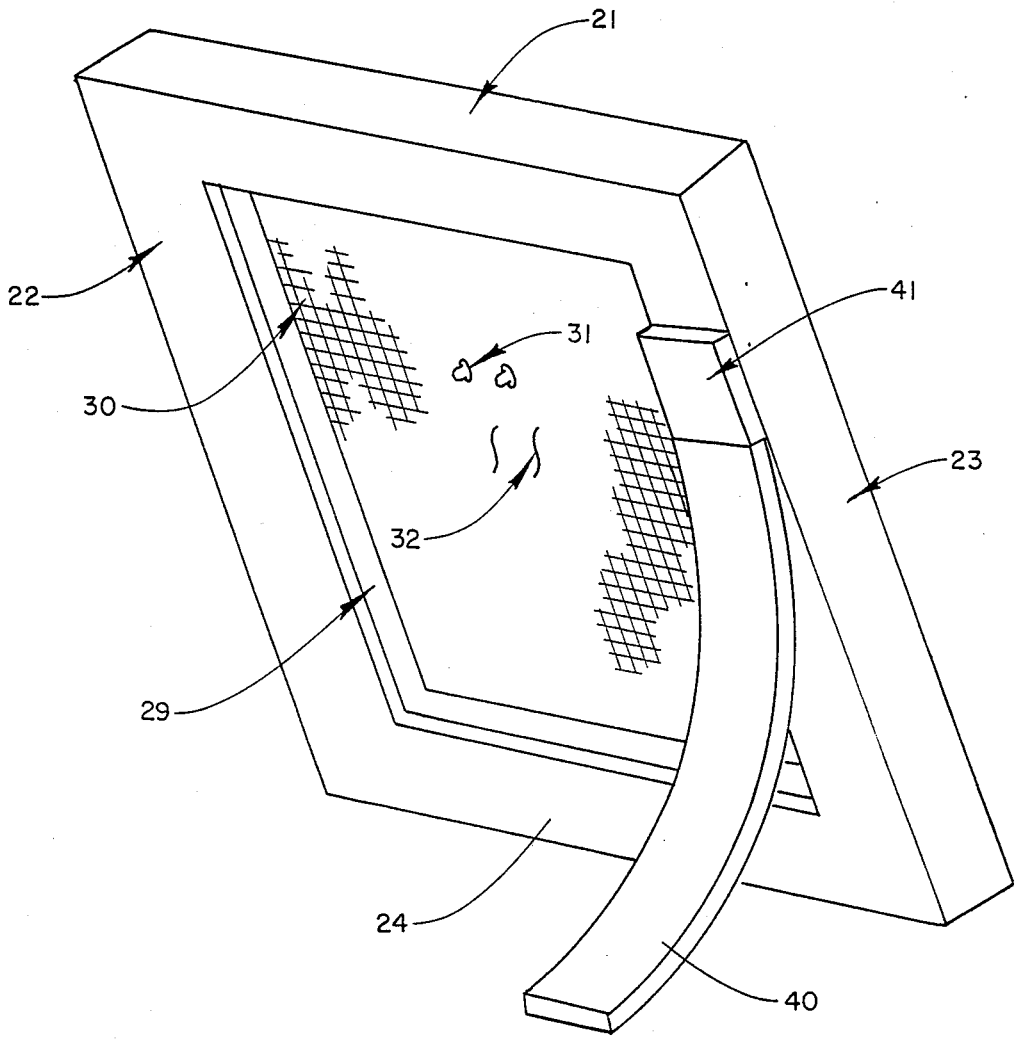
FIG. 4 is a perspective view of the back of the device in FIG. 1 held up by a curved support leg which is inserted into an aperture on the back of the device.

In use, it is preferable that there be unobstructed access to the back of the frame for attaching clasps such as earring backs. In one preferred embodiment, the frame is held in an upright position by a curved support leg 40 that is detachably inserted into a receptacle 41 on the back of one side portion 22 or 23 of the outer frame. FIG. 4 shows a perspective view of the back of a frame supported by a curved stand. By curving outward from the lower portion of the frame, it provides attractive, sturdy support. Only one stand is necessary, so that there is a minimum of obstruction in reaching the back of the display panel. Optionally, two stands could be used, one on either side frame portion; the stand could be permanently attached; or other stand designs known to those familiar with the framing art could be used.

Figure 5:
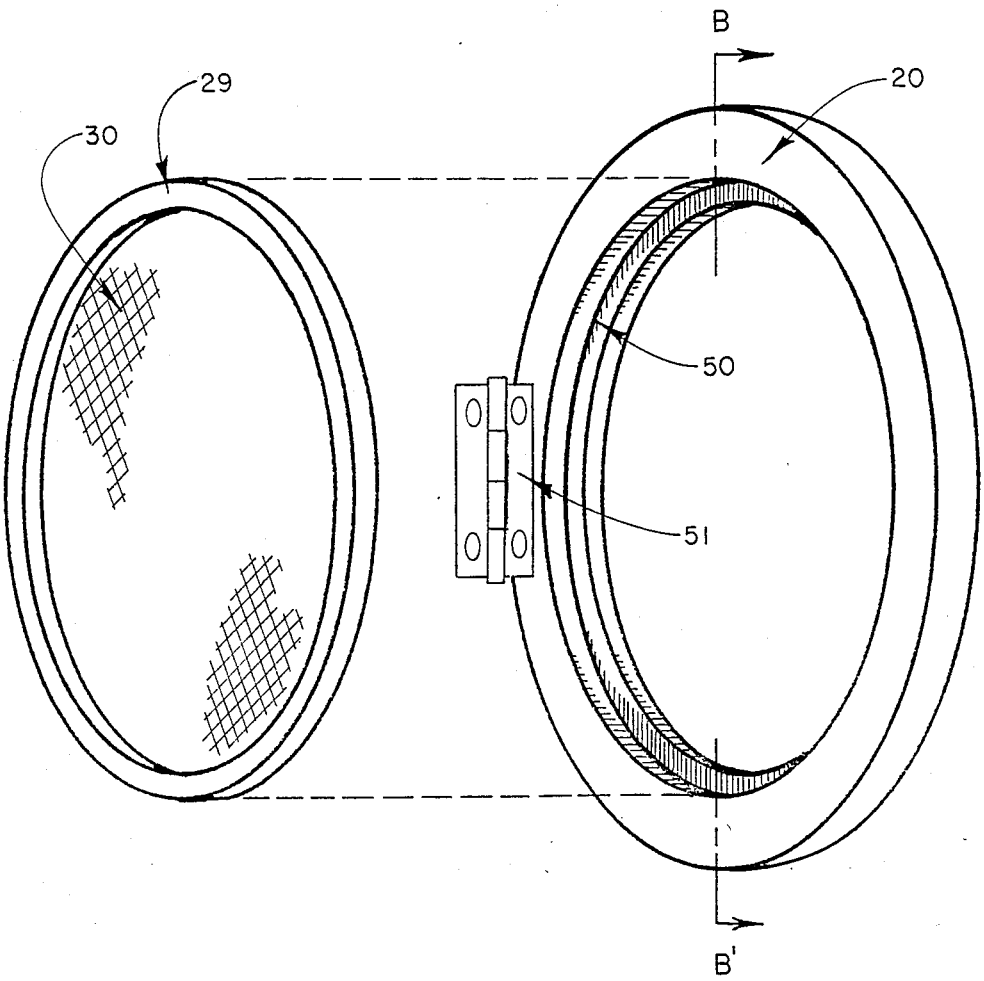
FIG. 5 is an exploded perspective view of the back of a circular embodiment of the device.

In another preferred embodiment, the device is mounted to a vertical surface, such as a wall, by a hinge or hinges. FIG. 5 shows a hinge 51 attached to one side of the outer frame 20. In use, the device swings away from the wall in a manner similar to a door. Both hands are free to attach the jewelry item, and access to the back of the frame is unrestricted.

Figure 6:
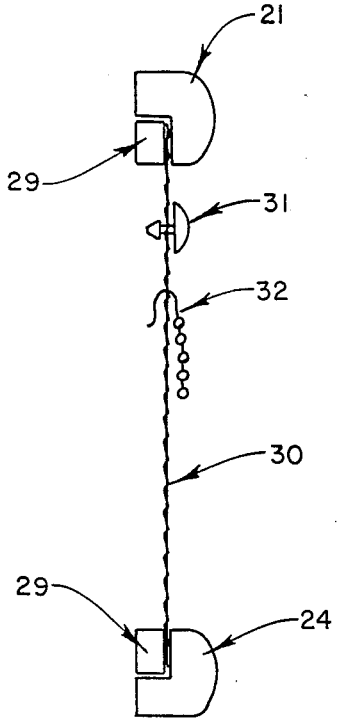
FIG. 6 is a cross-section view of the device as seen along plane B—B' of FIG. 5.

FIG. 5 shows an exploded perspective view from the back of a curved embodiment of the device. FIG. 6 is a cross-section taken in plane B—B' of FIG. 5. In this preferred embodiment, the inner frame 29 is inserted into a rabbet formed as an L-shaped recess 50, from the back of the outer frame, in a manner similar to many picture frames. This embodiment is strongly preferred for many curved forms of the device in order to avoid the appearance of a slot around a large portion of the perimeter of the outer frame which would not be aesthetically pleasing to many users.

Figure 7:
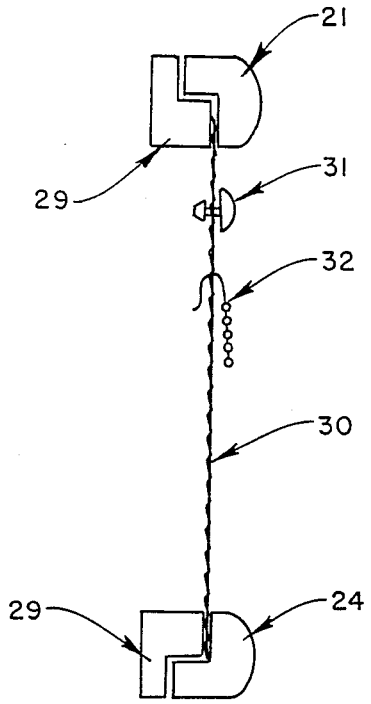
FIG. 7 is a cross-section view of the device as seen along plane B—B' of FIG. 5, showing an optional embodiment of the inner frame.

FIG. 7 is a cross-section taken in B—B' of FIG. 5, showing an optional embodiment of the inner frame shaped in such a way that it provides a smooth, finished surface to the back of the device, usable for attachment of a stand.

In a less preferred embodiment, the rabbet in the bottom frame portion 24 of FIGS. 1, 2 and 3 does not extend to the outer perimeter of the outer frame so that there is no opening in the outer frame. In this embodiment, the inner frame is inserted into the rabbet in the outer frame during construction of the outer frame.

It will be appreciated that the above described preferred embodiments of this invention can be modified without departing from the scope and spirit of this invention.

Thus, having disclosed my invention, I claim:

1. A device for displaying jewelry and the like having a decorative front fact and a back portion having at least one pin-like shaft, the device comprising: an outer frame having a central opening and a rabbet extending inwardly from and surrounding a substantial portion of the periphery of said opening; an inner frame shaped and sized to be received in said rabbet; slot means in an edge of said outer frame to allow access into said rabbet for the inner frame; a mesh panel adapted to be penetrated by the pin-like shaft and having means for attaching said panel to said inner frame; a curved supporting leg for holding the device in a substantially upright position; and said outer frame having means for receiving said supporting leg.

* * * * *